US006810809B2

(12) United States Patent
Detmers et al.

(10) Patent No.: US 6,810,809 B2
(45) Date of Patent: Nov. 2, 2004

(54) METHOD AND DEVICE FOR DRIVING A PRINTING PRESS

(75) Inventors: Andreas Detmers, Heddesheim (DE); Arno Jünger, Nussloch (DE); Jürgen Kreutzkämper, Sinsheim-Hoffenheim (DE); Sven Mader, Dielheim (DE); Christian Meier, Schriesheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/646,217

(22) Filed: Aug. 22, 2003

(65) Prior Publication Data

US 2004/0050272 A1 Mar. 18, 2004

Related U.S. Application Data

(62) Division of application No. 10/103,459, filed on Mar. 22, 2002.

(60) Provisional application No. 60/281,204, filed on Apr. 3, 2001.

(30) Foreign Application Priority Data

Mar. 22, 2001 (DE) ..... 101 14 095

(51) Int. Cl.[7] ..... B41F 13/004; B41F 5/00; B41F 31/00

(52) U.S. Cl. ..... 101/483; 101/216; 101/467; 101/463.1; 101/247; 101/248; 101/183

(58) Field of Search ..... 101/483, 183, 101/216, 467, 142, 181, 453, 211, 136, 137, 116, 463.1, 247, 218, 248, 118; 399/184

(56) References Cited

U.S. PATENT DOCUMENTS 3,594,552 A * 7/1971 Adamson et al. ..... 377/18
4,072,104 A 2/1978 Schaffer ..... 101/248
4,596,468 A * 6/1986 Simeth ..... 356/400
5,005,479 A * 4/1991 Lewis et al. ..... 101/467
5,062,364 A * 11/1991 Lewis et al. ..... 101/467
5,163,368 A * 11/1992 Pensavecchia et al. ..... 101/136
5,174,205 A * 12/1992 Kline et al. ..... 101/136
5,182,990 A * 2/1993 Kline et al. ..... 101/211
5,235,914 A * 8/1993 Williams et al. ..... 101/467
5,237,923 A * 8/1993 Williams et al. ..... 101/467
5,268,717 A * 12/1993 Imaizumi ..... 399/184
5,456,192 A * 10/1995 Trigg et al. ..... 112/470.05
5,540,424 A * 7/1996 Trigg et al. ..... 271/21
5,713,287 A * 2/1998 Gelbart ..... 101/467
5,740,054 A * 4/1998 Durr et al. ..... 700/122
5,826,505 A * 10/1998 Volz et al. ..... 101/183
5,887,526 A * 3/1999 Zahnd ..... 101/486

(List continued on next page.)

*Primary Examiner*—Andrew H. Hirshfeld
*Assistant Examiner*—Wasseem H. Hamdam
(74) *Attorney, Agent, or Firm*—Laurence A. Greenberg; Werner H. Stemer; Ralph E. Locher

(57) ABSTRACT

A method for driving a printing press includes driving, in a printing operation, via a gear train by at least a first motor, at least one drum for advancing printing material and a printing-form cylinder, processing angle-of-rotation signals of the drum in a control device for controlling the driving of the drum and the form cylinder, and driving, in a printing-form production operation in the printing press, a printing-form cylinder by a separate motor. The method further includes, in an operation for producing the printing form, synchronously actuating the first motor and the separate motor by providing a gear allocated to the driving of the printing-form cylinder, and an adjacent gear allocated to the driving of the drum of the gear train, the gears being disposed relative to one another at the most out of contact with one another, and at the least barely in engagement with one another so as to exert a slight pressure on one another, and a device for performing the method.

2 Claims, 4 Drawing Sheets

U.S. PATENT DOCUMENTS 5,979,317 A 11/1999 Singler ..... 101/218
6,009,807 A 1/2000 Yoshida et al. ..... 101/177
6,050,185 A 4/2000 Richards ..... 101/142
6,072,935 A * 6/2000 De With et al. ..... 386/68
6,101,944 A * 8/2000 Schmid et al. ..... 101/467
6,167,191 A * 12/2000 De With et al. ..... 386/112
6,216,592 B1 4/2001 Knauer et al. ..... 101/247
6,283,467 B1 * 9/2001 Iida ..... 271/82
6,327,975 B1 * 12/2001 Izawa ..... 101/170
6,332,397 B1 12/2001 Bolza-Schunemann et al. ..... 101/183
6,339,671 B1 * 1/2002 De With et al. ..... 386/68
6,349,643 B1 * 2/2002 Loftus et al. ..... 101/351.1
6,393,987 B1 * 5/2002 Bolza-Schunemann et al. ..... 101/483
6,668,721 B2 * 12/2003 Naka ..... 101/218
6,736,063 B2 * 5/2004 Murata ..... 101/247

* cited by examiner

METHOD AND DEVICE FOR DRIVING A PRINTING PRESS

CROSS-REFERENCE TO RELATED APPLICATION

This is a division of U.S. application Ser. No. 10/103,459, filed Mar. 22, 2002, which claimed the benefit of Provisional Application No. 60/281,204, filed Apr. 3, 2001.

BACKGROUND OF THE INVENTION

Field of the Invention

The invention relates to a method for driving a printing press, particularly a sheet-fed press having an integrated device for producing a printing form, and a device for performing the method.

Printing presses have become known heretofore wherein laser imaging heads are allocated to printing-form cylinders with which ink-accepting pixels or half-tone dots are generated on a printing plate or a printing form within the printing press. A variety of disruptions or disturbances act upon the imaging process, influencing the position of the pixels or half-tone dots on the printing plate or printing form. The printing-form cylinder is rotated during the imaging process, it being possible to gather or record the entire surface by guiding an imaging head parallel to the axis of rotation of the printing-form cylinder. The slightest mechanical vibrations and impacts acting upon the system of the printing-form cylinder and the imaging head cause imaging errors that cannot be corrected without further ado.

The published German Patent Document DE 692 22 035 T2 teaches a method whereby unroundnesses of a printing-form cylinder are corrected by controlling the time of an imaging process, pixel by pixel. The published German Patent Document DE 692 22 801 T2 describes an improvement wherein a correction value is assigned to each pixel to be set. Therewith, corrections can be made in both the circumferential and lateral directions of a printing-form cylinder. It is possible to compensate for periodic and predictable disturbance variables with such software-based methods. Disturbances due to high-frequency vibrations and impacts can be only inadequately compensated for due to the limited signal processing speed of a computer.

The published German Patent Document DE 197 23 147 A1 teaches a method for driving a printing press having an integrated imaging device whereby the drive of the printing-form cylinder is decoupled from the drive train, the printing-form cylinder is driven by a separate drive in the imaging operation, and following the imaging operation, the drive of the printing-form cylinder is reintegrated into the drive train in the operating-phase position. By decoupling the printing-form cylinder, influences of the drive train upon the imaging process are avoided. Because of the required clutch, this construction is quite expensive.

The published German Patent Document DE 198 22 893 A1 teaches a construction whereby all non-uniformly rotating subassemblies of a printing press are decoupled from the printing-form cylinder drive, and all uniformly rotating subassemblies are driven together with the printing-form cylinder. Besides one or more clutches, powerful motors are needed for the drive of the printing-form cylinder and the uniformly moving groups.

To prevent printing disturbances, the published German Patent Document DE 196 23 224 C1 describes a drive for a sheet-fed press wherein printing-unit cylinders can be driven while mechanically decoupled from the gear train of a sheet transfer system. By the separate driving of a plate cylinder, for example, the effects of load fluctuations in the gear train of the sheet transfer system on the plate cylinder during the printing operation are prevented. The separate driving of a plate cylinder additionally permits the correction of the circumferential register and the print length and an improvement in the flexibility, because plate exchange and washing processes can occur in unoccupied printing units during the printing operation. The angular synchronicity between plate cylinders and the sheet transfer system must be realized by an intensive or expensive control.

SUMMARY OF THE INVENTION

It is accordingly an object of the invention to provide a method and a device for driving a printing press wherein a driving concept for a printing press with an integrated imaging device is developed which permits both the printing operation and a faultless imaging operation, with little outlay.

With the foregoing and other objects in view, there is provided, in accordance with one aspect of the invention, a method for driving a printing press, which comprises driving, in a printing operation, via a gear train by at least a first motor, at least one drum for advancing printing material and a printing-form cylinder; processing angle-of-rotation signals of the drum in a control device for controlling the driving of the drum and the form cylinder; driving, in a printing-form production operation in the printing press, a printing-form cylinder by a separate motor; and in an operation for producing the printing form, synchronously actuating the first motor and the separate motor by providing a gear allocated to the driving of the printing-form cylinder, and an adjacent gear allocated to the driving of the drum of the gear train, the gears being disposed relative to one another at most out of contact with one another, and at least barely in engagement with one another so as to exert a slight pressure on one another.

In accordance with another mode, the method of the invention further comprises, during the printing-form production operation, processing, in the control device, signals indicating the angle of rotation of the printing-form cylinder.

In accordance with a concomitant aspect of the invention, there is provided a printing press comprising a gear train for driving a printing-form cylinder and at least one drum for advancing printing material; at least one first motor for driving the printing press during a printing operation and an additional motor for driving the printing-form cylinder during a production of a printing form in the printing press; a rotary position transducer for detecting an angular position of the printing-form cylinder and the drum, respectively, during the printing operation; a motor control device connected to the rotary position transducer; and an additional rotary position transducer connected to the motor control device for detecting an angular position of the printing-form cylinder during the production of the printing form.

The invention is based on the concept that, by a control device for a printing press drive, a motor for driving a printing-form cylinder is so actuated relative to a main drive train of the press in an imaging operation that no contact of tooth sides or flanks occurs between the gears driving the printing-form cylinder and those powering the main drive train. Thus, no torsional vibrations are transferred to the main printing-form cylinder from the main drive train. This improves the quality of the imaging of the printing-form cylinder.

Applying the method of the invention, a printing press can be constructed so that, during a printing operation, it is driven by one or more motors that are coupled to the main drive train. The separate motor for driving the printing-form cylinder can be deactivated during the printing operation or can act as an auxiliary drive to secure the contact of the tooth sides or flanks and/or to prevent printing disturbances or errors. In the imaging operation, both motors are controlled by one control device. In contrast with the printing operation, in order to prevent a transfer of vibrations to the printing-form cylinder, the tooth-side or tooth-flank contact between two gears, which are allocated to the main drive train and the secondary drive train for driving the printing-form cylinder, respectively, is prevented. The main drive train and the secondary drive train are advantageously driven so that the gears which are allocated to the transfer cylinder and the printing-form cylinder do not contact one another. It is advantageous, when signals are transmitted by a rotary position transducer for indicating the angle of rotation and the torsional vibrations of the transfer cylinder, and processed in the control device. Clutches for separating from the main drive train and the secondary drive train can be dispensed with. Because the gear train in the printing press does not have to be disengaged, assurance is provided that the angular position will not be shifted by clutch-engagement and clutch-disengagement operations.

Other features which are considered as characteristic for the invention are set forth in the appended claims.

Although the invention is illustrated and described herein as embodied in a method and a device for driving a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
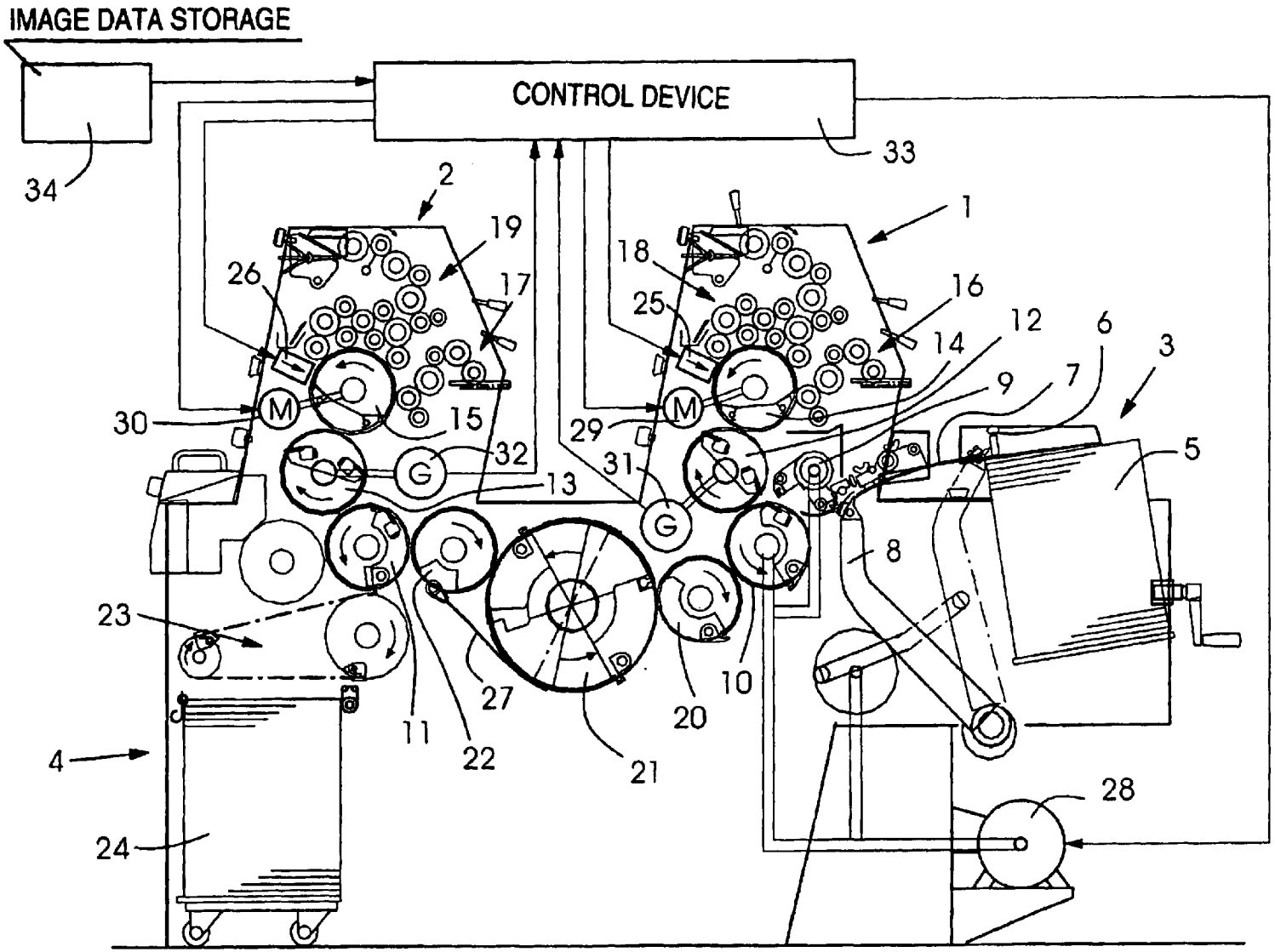
FIG. 1 is a diagrammatic and schematic side elevational view of a printing press incorporating the drive or driving device according to the invention.

Referring now to the drawings and, first, particularly to FIG. 1 thereof, there is shown therein diagrammatically and schematically a two-color sheet-fed printing press. The printing press has two printing units 1 and 2 disposed serially, i.e., in unit construction, a feeder 3, and a delivery 4. The feeder 3 has a sheet pile 5, a separator or singularizer 6, a feeding table 7, and feed devices 8, 9. In each printing unit 1, 2, there is an impression cylinder or drum 10, 11, a transfer cylinder or drum 12, 13, a printing-form cylinder 14, 15, a dampening unit 16, 17 and an inking unit 18, 19. The impression cylinders 10 and 11 of the printing units 1 and 2, respectively, are mutually connected operatively with a transfer drum 20, a storage drum 21, and a reversing drum 22. The delivery 4 has a chain gripper system 23 and a sheet pile 24. To produce a printing form inside the printing press, an imaging head 25, 26 is allocated to each printing-form cylinder 14, 15, respectively. The elements 6, 8, and 9 of the feeder 3, which advance the sheet 27; the cylinders 10, 11, 12, 13, 14, 15, 20, 21, and 22 in and between the printing units 1 and 2; the driven rollers of the inking and dampening units 16 to 19; and the elements 27 of the delivery 4, which advance the sheet 23, are connected to one another by way of a common gear train and are driven by a main drive motor 28. The printing-form cylinders 14 and 15 can also be driven by respective secondary drive motors 29 and 30. Rotary position transducers 31 and 32 are provided at the transfer cylinders 12 and 13, respectively, for detecting the angle of rotation of the transfer cylinders 12 and 13. A control device 33 is connected to the rotary position transducers 31 and 32 for the signal input and to the main drive motor 28, the secondary drive motors 29, 30 and the imaging heads 25, 26 for the signal output. The control device 33 also receives signals from an image data storage unit 34.

Figure 2:
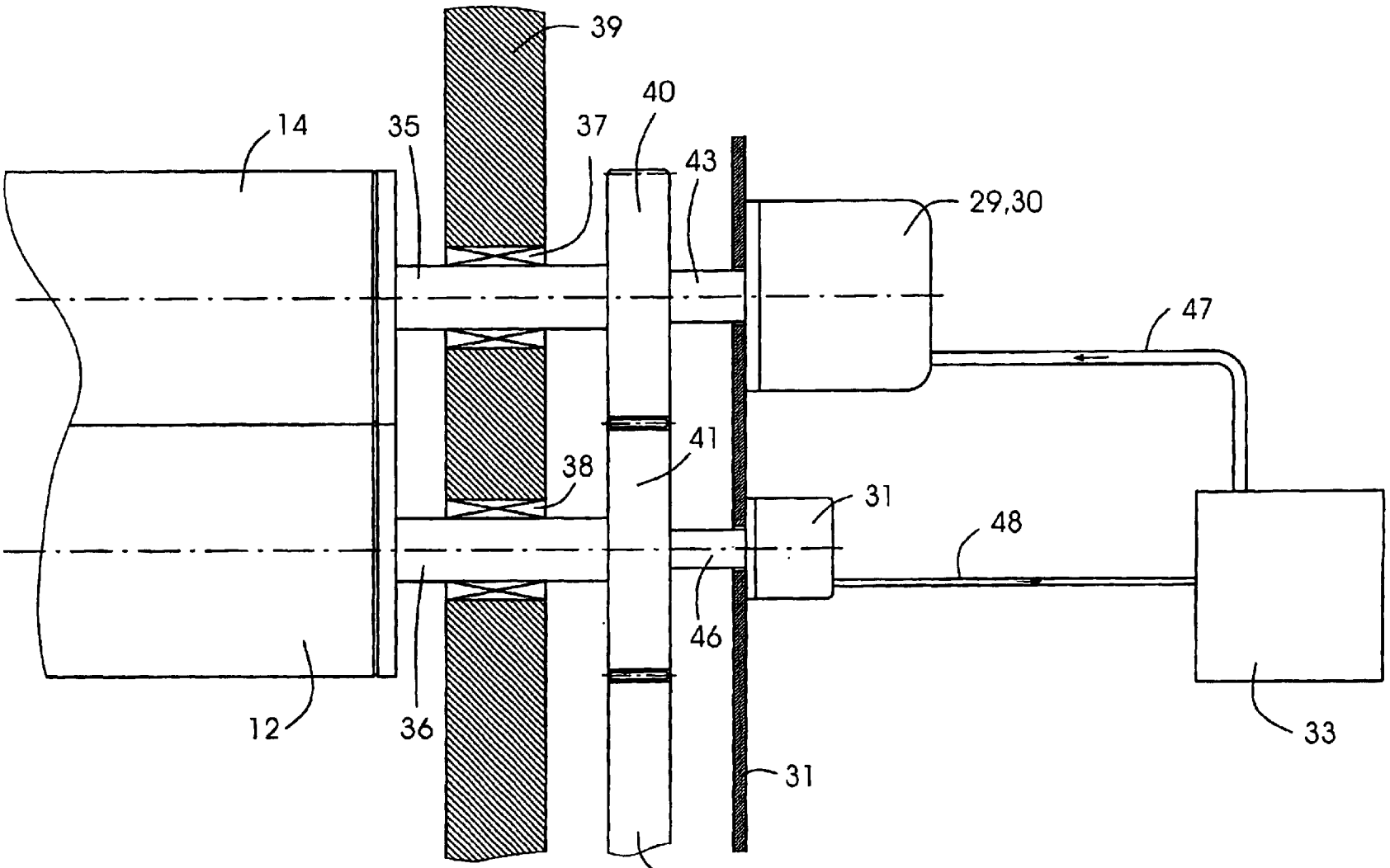
FIG. 2 is a fragmentary enlarged front elevational view, partly in section, of FIG. 1, showing the drive.

FIG. 2 more closely shows details of the drive of the printing press. FIG. 2 shows the printing-form cylinder 14 and the transfer cylinder 12, which are held in a sidewall 39 of the press with the journals 35 and 36 thereof in respective bearings 37 and 38. Gears 40 and 41 are secured on the respective journals 35 and 36. The gears 40 and 41, together with other gears 42, belong to a closed gear train, which is coupled with the main drive motor 28. For separately driving the printing-form cylinder 14, a secondary drive motor 29 is provided having a motor shaft 43 connected to the gear 40. The secondary drive motor 29 is secured in a holding device 44. To detect the angle of rotation of the transfer cylinder 12, a rotary position transducer 31 is secured in the holding device 44 for the secondary drive motor 29, the transducer shaft 46 being connected to the gear 41. A control line 47 extends from the control device 33 to the secondary drive motor 29. The rotary position transducer 31 is connected to the control device 33 via a signal line 48. The drive in the printing unit 2 is constructed equivalent to that afore-described for the printing unit 1.

Figure 3:
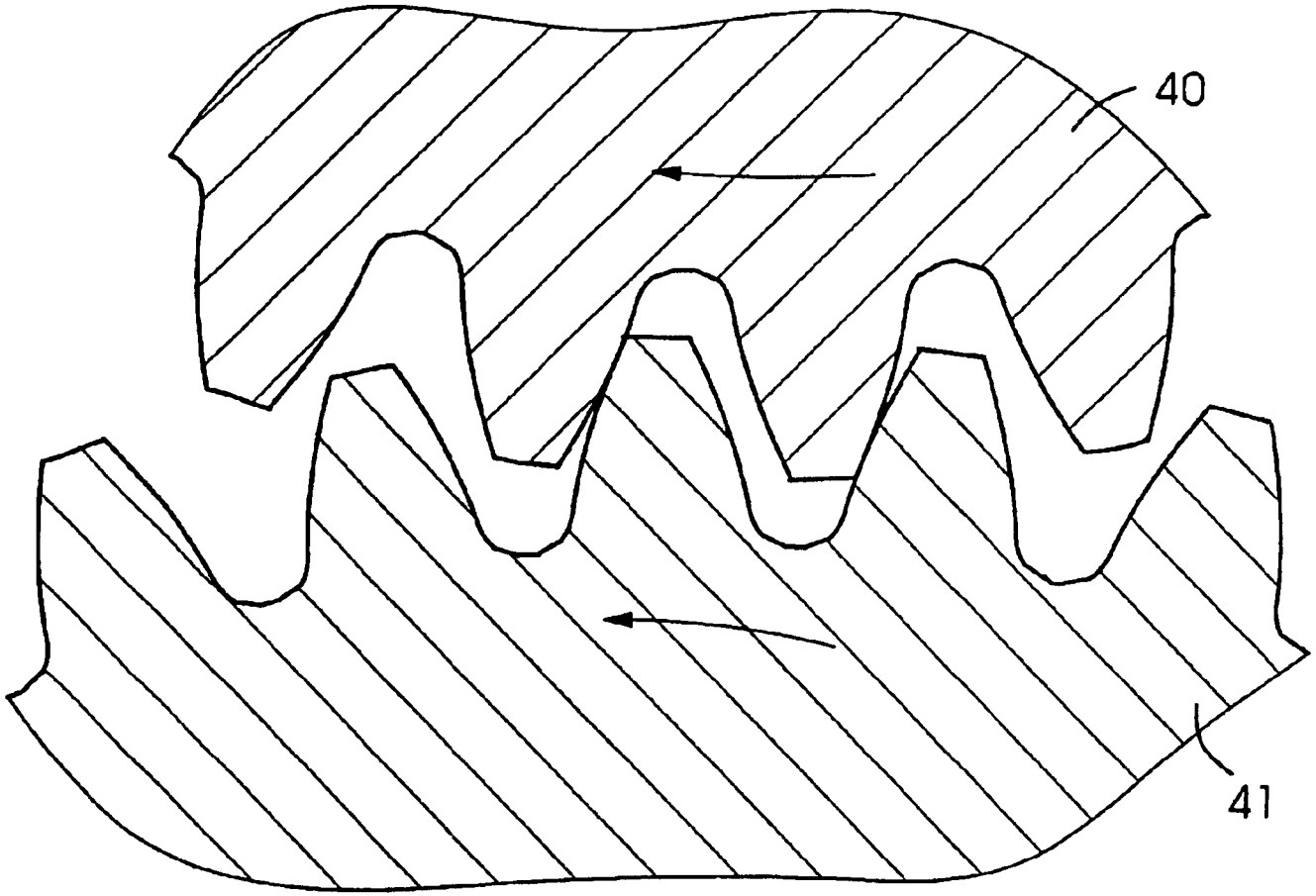
FIG. 3 is an enlarged fragmentary sectional view of a gear pair in a printing operation.
Figure 4:
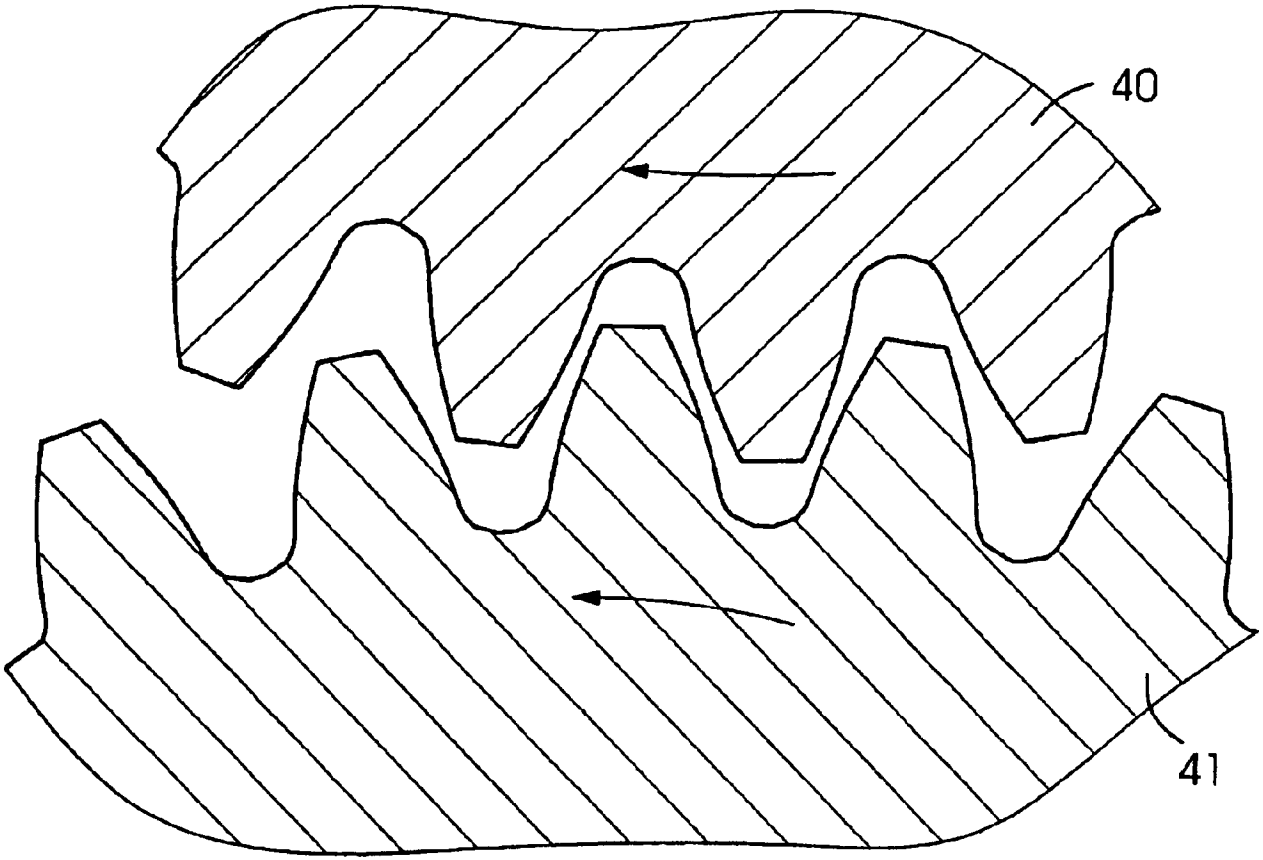
FIG. 4 is a view like that of FIG. 3 showing the gear pair in an imaging operation.

FIGS. 3 and 4 illustrate the functioning of the drive system. In the printing operation, the drive system operates in a first mode. The drive train is operated so that the sides or flanks of the teeth of the gears 40 and 41 and of those of the corresponding gears of the transfer cylinders 13 and the printing-form cylinder 14, respectively, in the printing unit 2, as represented in FIG. 3, are in contact with one another. The tooth flank or side contact is continuously maintained during the printing operation in order to prevent doubling phenomena. Expediently, the secondary drive motor 29 can also be operated so as to exert a slight braking influence, so that the tooth flank or side contact is also maintained even when sharp load fluctuations occur.-

In the imaging operation, the drive system operates in a second operating mode. As represented in FIG. 4, the printing-form cylinders 14 and 15 are driven by the secondary drive motors 29 and 30, respectively, so that the tooth side or flank contact of the gears 40 and 41, and the corresponding gears of the transfer cylinder 13 and the impression cylinder 15, respectively, in the printing unit 2, is eliminated or is so slight that no mechanical disturbances are transferred to the printing-form cylinders 14 and 15 via the drive train. It is also possible for some of the gears belonging to the respective inking units 18 and 19, or dampening units 16 and 17, respectively, to be driven via the secondary drive motors 29 and 30. In order to eliminate the tooth flank or side contact or reduce it to a harmless scale, the actual values of the angle of rotation and the torsional vibrations that are present at the respective transfer cylinder 12, 13 are continuously fed to the control device 33 via the signal line 48. These signals are processed in the control device 33 into actuating signals for the main drive motor 28 and the secondary drive motors 29 and 30, respectively. The control of the angular synchronicity of the gears 41 and 42 of the main drive train relative to the gears 40 of the secondary drive train is dynamic enough reliably to prevent tooth-flank or side contact between the gears 40 and 41.

In another embodiment of the invention, it is possible, additionally, to process, in the control device 33, signals from additional rotary positional transducers 49 and 50, which are coupled with the rotation of the printing-form cylinders 14 and 15, respectively.

We claim:

1. A method for driving a printing press, which comprises the steps of:

driving a printing-form cylinder having an allocated gear and at least one drum for advancing printing material having a further allocated gear adjacent the allocated gear of the printing form cylinder, via a gear train driven by at least one first motor;

processing angle of rotation signals of the at least one drum and printing-form cylinder in a control device to control the driving of the at least one drum and the printing-form cylinder;

driving the printing form cylinder with a separate motor during a printing-form production operation in the printing press; and synchronously actuating the first and the separate motor for driving the allocated gear and the further gear to place the gears relative to one another, at most out of contact with one another and at least barely in engagement with one another, for exerting a slight pressure on one another.

2. The method according to claim 1, which further comprises, during the printing-form production operation, processing in the control device signals indicating the angle of rotation of the printing-form cylinder.

* * * * *